US008555540B2

(12) United States Patent
Woodford

(10) Patent No.: US 8,555,540 B2
(45) Date of Patent: Oct. 15, 2013

(54) FIREARM SAFETY DEVICE AND METHOD OF USING SAME

(75) Inventor: Marshall Woodford, Port Orchard, WA (US)

(73) Assignee: Woodford Solutions LLC, Port Orchard, WA (US)

( * ) Notice: Subject to any disclaimer, the term of this patent is extended or adjusted under 35 U.S.C. 154(b) by 34 days.

(21) Appl. No.: 13/068,534

(22) Filed: May 13, 2011

(65) Prior Publication Data

US 2012/0285063 A1 Nov. 15, 2012

(51) Int. Cl.
*F41A 17/42* (2006.01)

(52) U.S. Cl.
USPC ..... 42/70.11

(58) Field of Classification Search
USPC ..... 42/70.11
See application file for complete search history.

(56) References Cited

U.S. PATENT DOCUMENTS

| | | | | |
|---|---|---|---|---|
| 4,569,144 | A * | 2/1986 | Thurber | 42/70.11 |
| 5,016,377 | A * | 5/1991 | Gunning | 42/70.11 |
| 5,412,959 | A | 5/1995 | Bentley | |
| 2003/0230123 | A1 | 12/2003 | Weinraub | |
| 2004/0025394 | A1 | 2/2004 | Young | |

* cited by examiner

*Primary Examiner* — Stephen M Johnson
(74) *Attorney, Agent, or Firm* — Galvin Patent Law LLC; Brian R. Galvin

(57) ABSTRACT

A firearm safety device for use with a handgun equipped with a blowback mechanism for automatic operation, comprising a barrel end piece adapted for insertion into or around an end of a barrel of the handgun and a substantially non-stretchable cable attached at a first cable end to a first side of the barrel end piece, is disclosed. According to the preferred embodiment, when the cable is wrapped around a rearward portion of the handgun and a second cable end is secured to a second side of the barrel end piece, the cable is placed under tension, and the tension on the cable pulls the handgun's barrel into a safe position.

7 Claims, 7 Drawing Sheets

FIREARM SAFETY DEVICE AND METHOD OF USING SAME

BACKGROUND OF THE INVENTION

1. Field of the Invention

The present invention is in the field of firearms, and in particular in the field of safety devices for handguns.

2. Discussion of the State of the Art

There are many instances where it is desirable for a person to maintain a handgun in a loaded condition while ensuring its safety against inadvertent discharge. For instance, law enforcement personnel would enjoy improved readiness and safety if, instead of having to unload their handguns at home, only to have to reload them again prior to returning to work, they could safely stow their loaded weapons in a fashion that prevents inadvertent discharge by themselves or others. Similarly, some airline pilots have trained and serve as Federal Flight Safety Officers, in which capacity they are required to carry a loaded handgun with them while serving on aircraft crews. In order to prevent inadvertent discharge of these weapons, FFDOs are required to maintain their weapons in a locked condition that prevents their firing. For example, it is common to maintain safety of airborne handguns through use of safety holsters that enable a padlock to be placed and locked in such a way that the padlock's shaft passes behind a weapon's trigger, rendering it unfireable. The padlock also passes through special holes in the safety holster so that the weapon cannot be removed from the holster without unlocking the padlock. This arrangement, however, has proved problematic, since it is possible for padlocks to be incorrectly placed in front of a weapon's trigger (rather than behind it), with the unfortunate side effect that, by firmly seating the weapon in the holster, the weapon may inadvertently discharge and possibly cause serious injury or damage to an aircraft.

What is needed is a method for lockably securing loaded handguns in a way that combines portability, safety against inadvertent firing, and security against tampering.

SUMMARY OF THE INVENTION

In order to address the problems described above, the inventors disclose in a preferred embodiment a firearm safety device for use with a handgun equipped with a blowback mechanism for automatic operation, comprising a barrel end piece adapted for insertion into or around an end of a barrel of the handgun and a substantially non-stretchable cable attached at a first cable end to a first side of the barrel end piece. According to the preferred embodiment, when the cable is wrapped around a rearward portion of the handgun and a second cable end is secured to a second side of the barrel end piece, the cable is placed under tension, and the tension on the cable pulls the handgun's barrel into a safe position.

According to a further embodiment of the invention, the second cable end is fitted with a cable end piece adapted to allow use of a locking device to lock the second cable end to the second side of the barrel end piece, thus lockably placing the cable under tension. According to yet another embodiment of the invention, the locking device is a padlock. In another embodiment, the barrel end piece further comprises a barrel insertion device adapted to allow close fit between the barrel insertion device and a barrel of the handgun. In a further embodiment, the barrel insertion device is made of a rigid material softer than the lining of the barrel of the handgun. In yet another embodiment, the barrel insertion device is removable, and in some embodiments a plurality of barrel insertion devices of different heights are adapted to provide a means for varying tension on the cable. In another embodiment of the invention, two parallel sides of the barrel end piece are adapted to allow them to move in tandem in order to vary an internal distance between the two sides, and further adapted to allow the two parallel sides to be locked in a desired pair of positions corresponding to a desired internal distance between the two sides.

In another preferred embodiment of the invention, a method of using a firearm safety device with a handgun equipped with a blowback mechanism for automatic operation is disclosed. The method comprises the steps of: (a) placing a barrel end piece in or around a barrel of the firearm, (b) wrapping a cable affixed at a first end to a first side of the barrel end piece around a rear portion of the handgun, (c) pulling a cable end piece attached to a second end of the cable forward to a position along a second side of the barrel end piece, and (d) attaching the cable end piece to the second side of the barrel end piece, thereby placing the cable under tension and pulling the barrel or slide of the handgun into a safe position.

BRIEF DESCRIPTION OF THE DRAWING FIGURES

DETAILED DESCRIPTION

Figure 1:
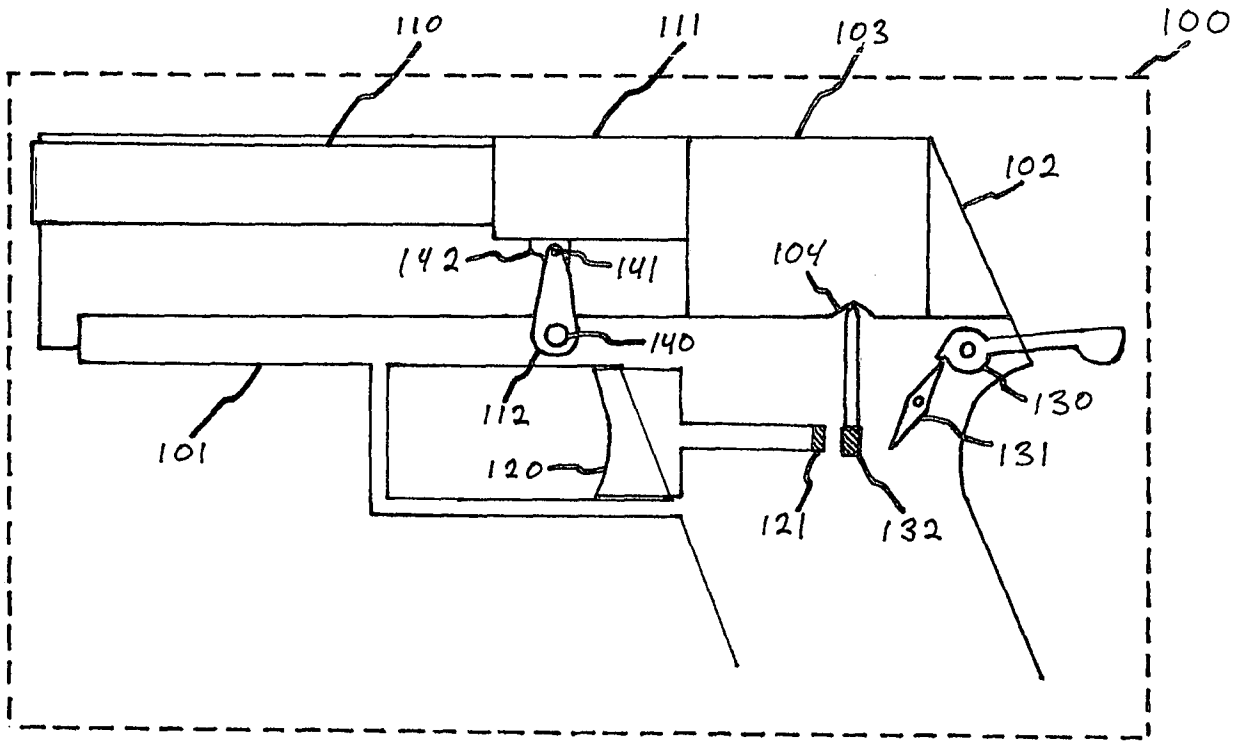
Fig. 1 Prior Art
FIG. 1 is an illustration of a prior art firearm, pointing out relevant features necessary for understanding the invention.

FIG. 1 provides an illustration of a typical firearm, well known in the art, with reference to which many aspects of the present invention will be illustrated. The prior art firearm 100 illustrated (partially) in FIG. 1 is a semi-automatic pistol, that is, a handgun that can be fired in semi-automatic mode, firing one cartridge for each pull of the trigger. Whereas other types of handguns accomplish this function for example by using multiple chambers and a single barrel (revolvers) or multiple chambers and barrels (for example, some derringers), semi-automatic pistols use a single chamber and a single barrel, which remain in a fixed linear orientation relative to each other while being fired and reloaded semi-automatically. Some terms that have been, or still are, used as synonyms for semi-automatic pistol are automatic pistol, self-loading pistol, self-loader, auto-pistol, and autoloader. Semi-automatic handguns use energy of one shot to reload the chamber for a subsequent shot (the term semi-automatic refers to the fact that the user still needs to pull the trigger to fire another shot; in an automatic weapon, as long as a user holds the trigger in a firing position, the weapon continues to fire automatically at a rapid rate). Typically, recoil energy from a fired round is harnessed mechanically via either recoil operation or blowback operations; however, larger calibers may also be gas operated, and many variations of semi-automatic handgun design are known in the art. After a round is fired from a handgun, the handgun will cycle, ejecting a spent casing and chambering a new round from a magazine, allowing another shot to take place as soon as the trigger is again pulled. While as mentioned multiple methods of enabling semi-automatic operation are known in the art, one example will be discussed here in detail to illustrate a key concept known in the art and relevant to the present invention, which is the fact that many semi-automatic handguns use a mechanism in which, when a handgun's barrel is pulled back from its rest position, the handgun is rendered safe (unable to fire). The example to be discussed is often referred to in the art as the Browning blowback mechanism, which is one method for automatically ejecting spent rounds and advancing new rounds into firing position, thus providing one means of operating an automatic handgun 100.

Figure 2:
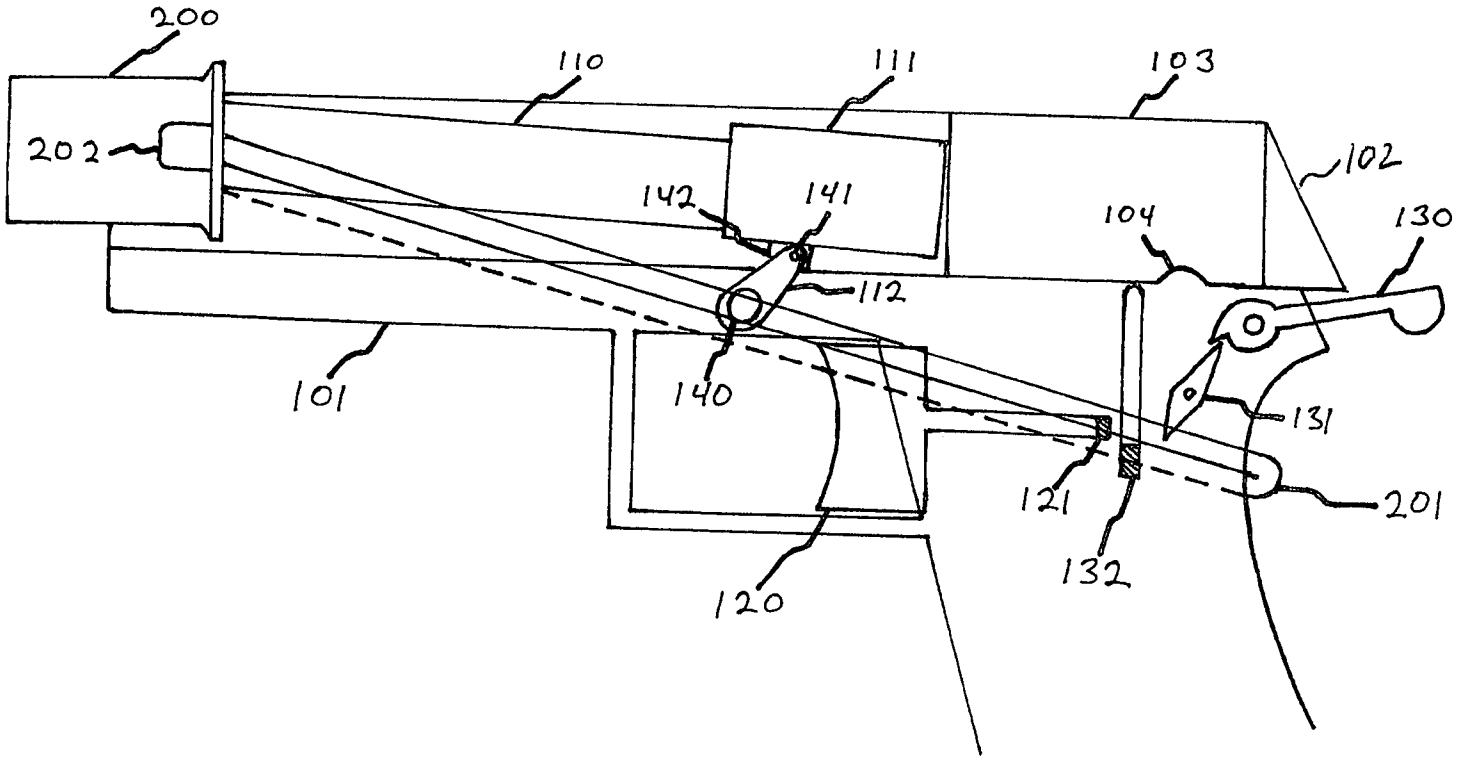
FIG. 2 is an illustration of an embodiment of the invention, showing particularly how the invention prevents inadvertent firing of a firearm.

Exemplary handgun 100 is comprised of a frame 101, also known in the art as a receiver, and a slide 102 adapted to move forward and afterward with respect to frame 101 (that is, to the left and to the right in FIG. 1). Slide 102 further comprises a bolt mechanism 103, a chamber 111, and a barrel 110. Bolt 103 acts as a rear pressure boundary to chamber 111, and chamber 111 is precisely aligned with the bore of barrel 110 when slide 102 is in its forward-most, ready to fire position, as shown in FIG. 1. Barrel linkage 142 is a (typically metallic) pin rotably coupled to a pin 140 rigidly mounted to frame 101 and a second pin 141 rigidly mounted to member 142, which is itself rigidly attached to chamber 111. Trigger 120 operates to cause firearm 100 to fire (when a round is chambered in chamber 111). When an operator pulls trigger 120 back (to the right in FIG. 1), trigger bar 121 impacts disconnector 132, via a metallic extension of disconnector 132, shown as a shaded region on the lower end of disconnector 132. Disconnector 132 is typically a long piece of flexible metal with an L-shaped extension, shown shaded in FIG. 1, at its lower extremity, such that if disconnector 132 is pushed down as shown in FIG. 2, trigger bar 121 cannot engage the extension of disconnector 132 and therefore pulling of trigger 120 when slide 102 is in its rearward-most, safe position as is shown in FIG. 2 does not fire handgun 100. When a handgun is in the position of FIG. 1 and trigger 120 is pulled causing trigger bar 121 to engage the L-shaped extension of disconnector 132, disconnector 132 moves to the rear of handgun 100 and impinges sear 131, causing sear 131 to rotate counterclockwise and releasing hammer 130, which in the "ready" position shown in FIG. 1 is stopped from upward (counterclockwise) motion by its ratchet being engaged by sear 131 (as shown in FIG. 1). When sear 131 is moved out of the way of the ratchet by rotating counterclockwise, hammer 130 is driven by a compressed spring (not shown) to rapidly rotate upward until it impinges on the rear of slide 102, and specifically on the handgun's firing pin.

When hammer 130 is released and impinges on firing pin at the rear of slide 102, if a round is chambered in chamber 111 the firing pin impinges on the rear of the round (the round consisting a casing loaded with explosive and a bullet firmly embedded in the end of the casing), causing the explosives in the round's casing to explode, further causing a rapid gas expansion in chamber 111. Since block 103 provides a pressure seal to the rear of chamber 111, all of the explosive energy is released in the forward direction (to the left in FIG. 1), causing the bullet to exit the casing contained in chamber 111, pass through barrel 110, and exit handgun 100 at high velocity. When a round is fired as just described, the force of the explosion pushes back on block 103 (which, as mentioned, provides a pressure seal for the rear of chamber 111), causing slide 102 to move backwards (to the right in FIG. 1). This rearward motion of slide 102 causes barrel linkage 112 to rotate clockwise, and since pin 140 and pin 141 are fixed to frame 101 and barrel 110 respectively, the rear portion of barrel 110 is pulled downward as shown in FIG. 2 shortly after firing. Additionally, as slot 104 in underside of block 103 moves rearward after firing, disconnector 132 is forced downward as it leaves slot 104, thus disconnecting its L-shaped (shaded in FIGS. 1 and 2) extension from trigger bar 121, as shown in FIG. 2. The downward motion of barrel 110 after firing serves two important purposes. First, it allows a new round to be easily (and automatically) loaded from a magazine typically located in a hand grip of frame 101 (the mechanism for reloading is not relevant to the invention and is not shown or described in detail). Second, when slide 102 is in its rearward-most position and barrel 102 is tilted clockwise from horizontal (as shown in FIG. 2), handgun 100 is in a safe position—until slide 102 moves forward again (which is done automatically when a new round is loaded, or can be done manually; these mechanisms are not shown or described as they are not relevant to the invention), handgun 100 cannot be fired because barrel 110 is out of alignment with chamber 111 and disconnector 132 is in a depressed position wherein trigger bar 121 is unable to contact its extension and cause deflection of disconnector 132 into sear 131.

Again, it is important to emphasize that the above mechanism is described in some detail to illustrate one method, among many known in the art, where semi-automatic handgun operation is enabled by a mechanism that involves a safety mechanism wherein, when barrel 110 is pulled rearward along with slide 102, the weapon is rendered safe, becoming capable of firing again only after barrel 110 and slide 102 have referred to their original positions (and therefore also after a new round has been loaded into chamber 111). For example, another analogous method known in the art, and with respect to which the instant invention is equally applicable, is a method known used in weapons known as "striker pistols", which do not use disconnector 132 (because for example disconnector 132 is easily broken) but instead are made to fail in a safe position by use of a fire pin block or a striker safety block, either of which is held in place in a safe position by spring pressure, blocking a firing pin (or striker) until it is pushed out of place either by sear 131 or trigger bar 121. In such prior art examples, pushing slide 102 and barrel 110 rearward acts to prevent a firing pin safety block or striker safety block from being disengaged. It should be evident to one having ordinary skill in the art that any mechanism that is used for providing semi-automatic handgun operation and that places a handgun in a safe condition when barrel 110 is pulled rearward from its normal position to an out of battery position can be made safe using systems and methods of the present invention, as described below. Any references herein to disconnector 132 and internal linkage pins are for illustrating an exemplary semiautomatic handgun 100 and do not limit applicability of the present invention to handguns 100 that have disconnectors 132 or other specific elements; the invention applies to any handgun that can be made safe by pulling to the rear barrel 110 or slide 102 into a safe position.

FIG. 2 illustrates a preferred embodiment of the invention that makes advantageous use of the principle that handgun 100, when barrel 110 is out of battery (in a tilted, rearward position) cannot be fired. Normally slide 102 is only urged rearwards (to the right) by rapid expansion of gases during firing of handgun 100, as described above. However, according to the invention, handgun can be rendered lockably safe while loaded by applying an external force to force slide 102 into its rearward, inherently safe position (as described above, handgun 100 is safe when slide 102 is in rearward position because trigger bar 121 is prevented from contacting the L-shaped extension piece of disconnector 132, because connector 132 is forced downward as its top is forced downward out of notch 104 in block 103 as block 103 (a part of slide 102) moves rearwards. According to a preferred embodiment of the invention, barrel end piece 200 is fitted over the end of barrel 110 and then placed under tension by cable 201, which is fixed to barrel end piece 200 by an end plus 202 firmly attached to cable 201. End plug 202 is greater in width than cable 201, and is also greater than a diameter of a hole (not shown) in barrel end piece 200, through which hole cable 201 passes. A similar hole exists on a side of barrel end piece 200 opposite the side shown, on the other side of barrel 110, thus allowing barrel end piece 200 to be pulled in a rearward direction (to the right in FIG. 2) as cable 201 is placed under tension. Note that cable 201 passes behind a handgrip of frame 101 and then passes behind handgun 100 on its opposite side (indicated by the dotted line); with a suitable fastener on the opposite side cable 201 is easily placed under tension (various fasteners will be disclosed with reference to subsequent figured; here it is sufficient to note that, by placing cable 201 under tension, barrel end piece 200 is pulled back toward barrel 110 and forces barrel 110 into its out of battery (tilted) position, as shown in FIG. 2. In this fashion (which will be more clearly illustrated with reference to FIG. 3), by placing cable 201 under tension, one renders handgun 100 safe even though it may be (but need not be) loaded, and even though its safety device (not shown, but all firearms are equipped with safety devices known in the art) disengaged. It will be appreciated by one having ordinary skill in the art of handgun design and operation that, as long as cable 201 can be lockably placed under tension and is not subject to cable stretching, handgun 100 may be kept in a loaded but safe condition as shown, indefinitely. Further, to render handgun 100 unsafe (ready to fire), all that is needed is to release tension on cable 201 and to remove barrel end piece 200 from barrel 100. When tension in cable 201 is released, slide 103 automatically returns to its normal, ready-to-fire position (all the way forward, or to the left in FIG. 2); when the barrel end piece 200 is removed, handgun 100 is then ready to fire (assuming it is loaded; the invention can secure unloaded handguns 100 as well as loaded handguns 100).

Figure 3:
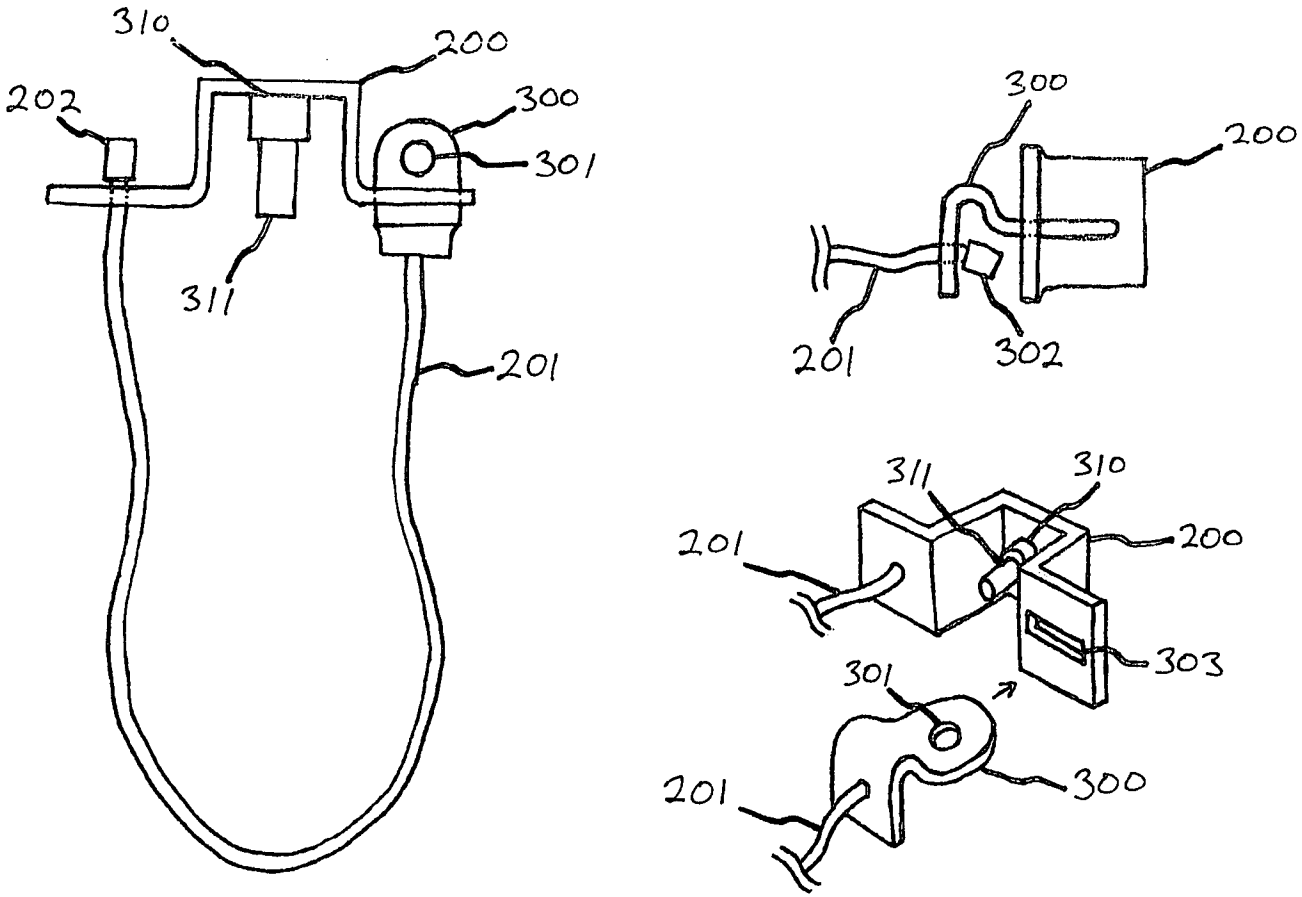
FIG. 3 is an illustration of a preferred embodiment of the invention.

FIG. 3 illustrates a preferred embodiment of the invention in a variety of perspectives to make its operation clear. In the embodiment, cable 201 is terminated at one end by fixed cable end plug 202 which is, as mentioned above, larger in diameter than the hole through barrel end piece 200 through which cable 201 is passed (left side of FIG. 3). Cable 201 is generally flexible, and is preferably made of metal or any other strong material. Specifically, cable 201 should be capable of bending around the handgrip of frame 101 of handgun 100, and strong enough that, when lockably placed under tension as illustrated in FIG. 2, cable 201 is not subject to stretching. Stretching of cable 201 would have two undesirable consequences. First, if cable 201 was able to stretch sufficiently, it would be possible to swing cable 201 around the bottom of the handgrip of frame 101 of handgun 100, thus enabling one to pull barrel endpoint 200 out of barrel 110 and thereby defeating the purpose of the invention. However, even a much lower amount of stretching may be sufficient to allow the spring tension which normally causes slide 102 to slide forward to push against barrel end piece 200, to a degree that is determined directly by how much cable 201 stretches. If cable 201 stretches sufficiently, barrel end piece 200 could be pushed forward enough to allow barrel 110 to return to its ordinary "in battery" position, that is to a position in which barrel 110 is aligned in parallel with frame 101 and slide 102, and further such stretching could allow disconnector 132 to return upward into slot 104 and thus to enable a coupling between trigger bar 121 and disconnector 132. As can be seen, anything more than very minor stretching of cable 201 could cause handgun 100 to become unsafe. Accordingly, any material used for cable 201 should be highly resistant to stretching. Flexible metal cables, such as are well known in the art, are preferably used for cable 201, although any flexible material of sufficient strength to resist stretching could also be used. It is also desirable for cable 201 to be resistant to cutting and shearing, to avoid intentional and unintentional severing of cable 201, which would have obviously deleterious effects on operation of the invention.

Cable 201 is terminated at its end opposite cable end plug 202 by end piece 300, which is held into cable 201 by cable end plug 302, which like cable end plug 202 is wider than the diameter of the hole in end piece 300 through which cable 201 is passed. End plugs 202, 302 can be fastened to cable 201 in any of a number of ways known in the art. For example, in one embodiment of the invention end plugs 202, 302 are welded to loose ends of cable 201 after cable 201 is passed through holes in barrel end piece 200 and cable end piece 300, respectively. In other embodiments, cable 201 is made of multiple metal wires wound into a single cable, and fastened to end plugs 202, 302 by crimping end plugs 202, 302 after insertion of cable 201 to ensure positive engagement. Many other approaches to permanently securing end plugs 202, 302 to cable 201 are known in the art, and it will be clear to one having ordinary skill in the art that any of them may be used according to the embodiment without departing from the scope of the invention. Additionally, cable 201 is in some embodiments coated with a heavy plastic of rubber-like substance to further resist fraying or inadvertent weakening of cable 201 through contact with sharp objects (such as sharp edges of handgun 201, or a blade of a cutting device. Such plastic or rubber-like coatings for cable 201 may also make cable 201 less prone to corrosion and less likely to cause scratching or other damage to handgun 201 (it is generally desirable, of course, for the invention to not damage handgun 201 in any way). Barrel end piece 200 is, according to the embodiment illustrated in FIG. 3, comprised of a singe piece of metallic bar stock shaped into approximately a U-shape with the tops of the "U" further bent outward to an orientation approximately parallel to the base of the "U", as shown in the leftmost portion of FIG. 3. In most embodiments, a flat portion in the middle of the length of barrel end piece 200 (the base of the "U") ends in two right angle bends, with two walls perpendicular to the middle section (the left and right sides of the "U") rising from the right angle bends. Each of these perpendicular elements terminates (away from the middle section) in another approximately right-angled bend, with the metal plate bending away from the middle section to a position approximately parallel to the middle section of barrel end point 200. One of these parallel end sections is penetrated by a hole just big enough to allow cable 201 to pass through it, and of a diameter less than cable end plug 202 so that cable 201 is permanently fastened to barrel end piece 200 as shown. In the other parallel end section, a slot 303 is provided which is long enough to permit passage of a distal (from cable 201) end of cable end piece 300. In most embodiments, slot 303 is made in a direction parallel to the common length dimension of the three parallel sections of barrel end point 200, although one could if desired make slot 303 at any other orientation as long as the strength of barrel end piece 200 is not compromised. Cable end piece 300 is shaped like a question mark, with a long section intended to pass through slot 303, and penetrated by a normally (but not necessarily) circular hole 301 through which a padlock can pass to lock cable end piece 300 in place by preventing it from being withdrawn back through slot 303. At approximately its middle, cable end piece 300 is bent upwards and the downwards to form an inverted semicircle ending in a shorter end section that is aligned approximately perpendicularly to the longer end section with hole 301. The shorter perpendicular end section is penetrated by a small hole through which cable 201 passes, and the radius of the approximately semicircular section is sufficiently large that cable end plug 302 can fit between barrel end piece 200 and the perpendicular section of cable end piece 300 through cable 201 passes (see lower right hand section of FIG. 3). Finally, according to the embodiment barrel end piece 200 comprises a barrel insertion cylinder 311, which has at its base a concentric larger-diameter barrel abutment cylinder 310. Generally these are machined as a single metallic or hard plastic piece, although they may be separate pieces as well. When locking a handgun in a safe position using an embodiment of the invention, barrel insertion cylinder 311 is inserted into the end of barrel 110 and cable 201 is wrapped around the handgrip of frame 101, and the long section of cable end piece 300 is inserted into slot 303. According to a preferred embodiment, a length of cable is provided that is suited for a particular handgun 100 model, such that when cable end piece 300 is inserted through slot 303, it is necessary to push against the perpendicular portion of cable end piece 300 in order to overcome spring resistance against, since as cable insert piece 300 is inserted through slot 303 the increasing tension on cable 201 acts to pull barrel 110 back and thus to pull slide 102 out of battery against spring tension. Once cable end piece 300 is fully inserted into slot 303, a locking device such as a padlock can be inserted into hole 301 to prevent spring tension from pushing slide 102 back forward (and pulling cable end piece 300 out of slot 303). It will be appreciated that, while a padlock is envisioned by the inventor, any semi-rigid implement that can fit through hole 301 can be used to lock cable end piece 300 in place and to render handgun 100 safe even if it is loaded and has a chambered round. It should be noted that according to a preferred embodiment the open end of barrel 110 abuts directly against barrel abutment cylinder 310, and barrel insertion cylinder 311 acts as a guide to keep barrel end piece 200 aligned with barrel 110. It is not necessary to have a barrel abutment cylinder 310; the end of barrel 110 could abut directly against the flat middle section of barrel end piece 200, according to the invention. Further, those having ordinary skill in the art will appreciate that, while a metallic barrel insertion cylinder 311 may be used, any other rigid substance such as hard plastic could be used as well. Use of a hard plastic barrel insertion cylinder may be preferable to eliminate or reduce likelihood of damage to internal portions of barrel 110, which typically are machined to very tight tolerances in order to ensure accurate and unimpeded passage of projectiles on firing of handgun 100. If hard plastic or even wood is used as the substance for barrel insertion cylinder, care must be taken to ensure that that substance is at least rigid enough not to be broken off while in barrel 110, which could undermine the security provided by the invention.

According to the invention, handgun 100 may be placed in a safe position, while loaded, using the instant invention, even when handgun 100 is placed in a holster with an open end (that is, a holster where the end of barrel 110 is accessible through a hole or other penetration of the holster, for the placement of barrel end piece 200 on barrel 110 while handgun 100 is holstered. This should be evident to anyone having ordinary skill the art of using a handgun, as placing handgun 100 into a holster and then placing barrel end piece 200 into barrel 110, wrapping cable 201 around a rearward portion of handgun 100 and then placing cable 201 under tension as described with reference to various embodiments herein, will not only pull barrel 110 rearward and render handgun 100 safe even while loaded, but will also fix handgun 100 in its inserted position relative to the holster. Thus use of any embodiment of the present invention is particularly well-suited to use with a holster or other similar device that can be used to suspend or mount a handgun 100 on a person's belt, shoulder harness or other appurtenance, or even to affix handgun 100 to an underside of a car dashboard, desk, or similar furnishing where it may be desirable to have a loaded but safed handgun 100 close at hand, since use of the invention will not only render a loaded handgun 100 safe but will also lockably fix it within a holster or other device with ease.

Figure 4:
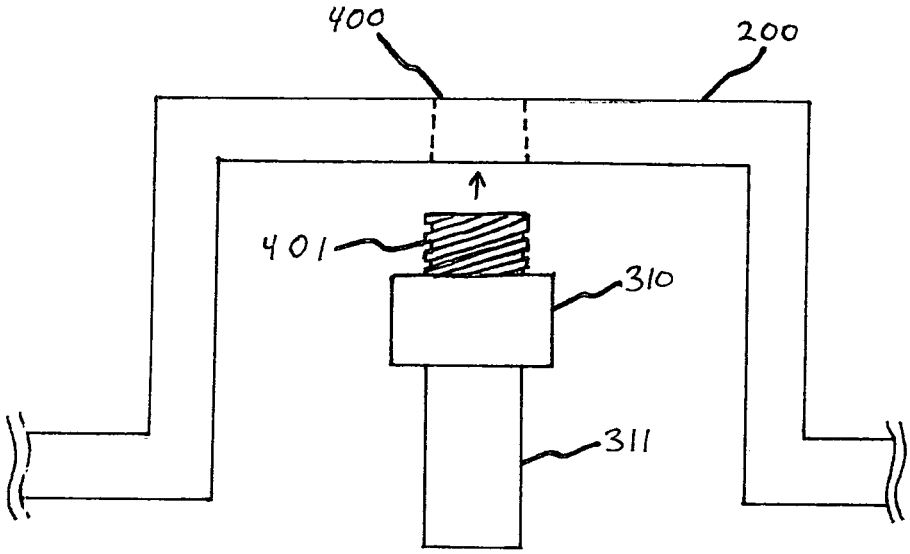
FIG. 4 is an illustration of another embodiment of the invention with removable barrel insertion elements.
Figure 4:
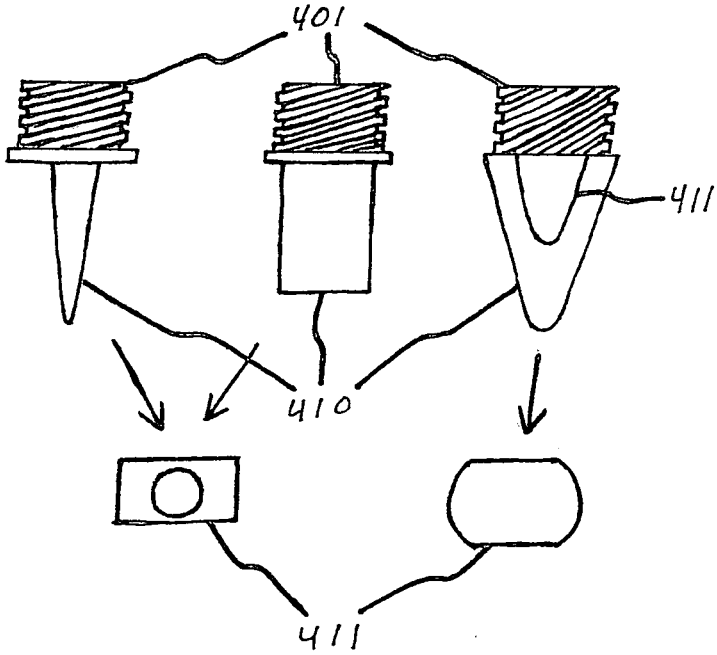

FIG. 4 illustrates an alternative embodiment of the invention in which barrel abutment cylinder 310 with associated barrel insertion device 311 has a threaded base 401, and barrel end piece 200 has a threaded hole 400 adapted so that any device with threaded base 401 may be affixed to barrel end piece 200. Barrel insertion devices can be inserted that exhibit a variety of shapes. For example, a shallow conical section, flattened on one side 411 to allow for easy turning and tightening using for example a small crescent wrench or a special tool adapted for inserting and removing various barrel insertion device with threaded bases 401 into threaded hole 400. Another example is the cylindrical barrel insertion device 311 with one pair of parallel sides 411 provided to allow for easy turning, and yet a third example is a broad conical section with a pair of parallel flat sides 411 that extend only as high as that portion of the broadened cylinder where the cylinder's width equals the separation between the parallel sides (again, this allows for easy manual or tool-assisted turning). The goal of having removable barrel insertion or barrel abutment devices is to allow one instance of the present invention to be usable for a variety of different firearms with potentially widely varying gages (barrel diameters). Another advantage of interchangeable barrel insertion devices is that a greater or lesser length of threaded base 411 or of an unthreaded lower portion of barrel insertion device will allow for differing handgun sizes with a single fixed-length cable 201 and will, alternatively, allow adjustments to cable 201 tension to ensure proper operation of the invention (by ensuring that slide 102 is retracted sufficiently to fully safe handgun 200). Since adding to the distance between the inner face of barrel end piece 200 and the point where contact is made with barrel 110 will in effect increase tension on cable 201 (assuming a constant length cable), and since conversely subtracting from the distance between the inner face of barrel end piece 200 and the point where contact is made with barrel 110 will decrease tension on cable 201, having a variety of interchangeable barrel insertion devices 311 will greatly add to the flexibility of the invention.

Figure 5:
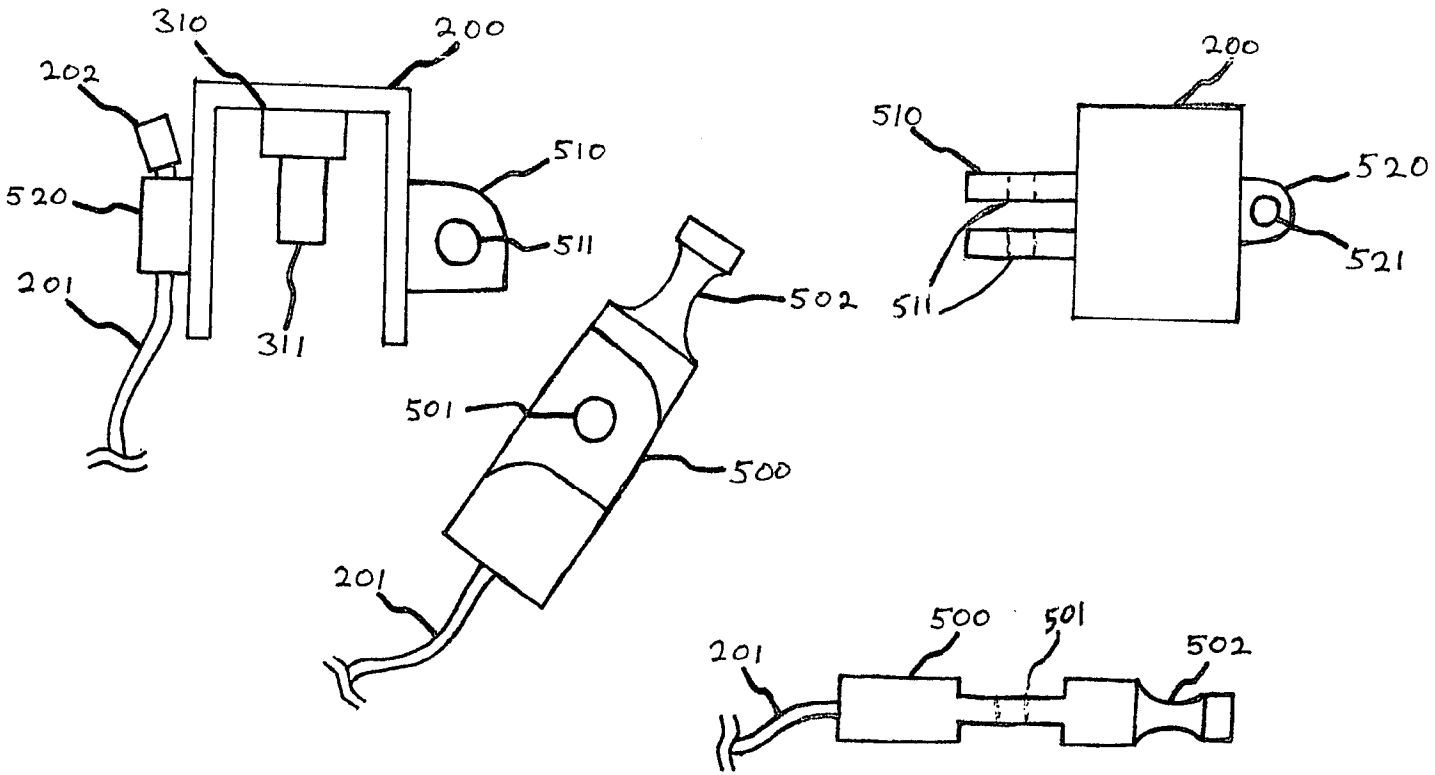
FIG. 5 is an illustration of another embodiment of the invention with an alternative locking mechanism.

FIG. 5 illustrates an alternative design for cable end piece 200, according to an embodiment of the invention. Barrel insertion device 311 and barrel abutment cylinder 310 are as before (and could be of the type described with reference to FIG. 4), but barrel end piece 200 is constructed differently and has different cable fixture mechanisms. A round or flat cable cover 520 with channel 521 is welded to a side of a rigid, U-shaped barrel end piece 200 (or alternatively cover 520 and barrel end piece 200 are cast as a single piece. Cable 201 passes through cable channel 521 and is terminated by cable end plug 202 as before, with dimensions of plug 202 being sufficient to make it impossible for cable 201 to pull out through cable channel 521. Alternative means of fastening cable 201 to cover 520 or channel 521 are envisioned by the inventor, for example a pin drilled through channel 521 that also passes through a link of a chain-type cable 201. It will be appreciated that there are many cable 201 types with suitable flexibility and strength characteristics, as discussed previously, and many ways known in the art for fastening of various types of cables 201 permanently using a channel 521 or equivalent. On the opposite side of barrel end piece 200, a pair of parallel rigid elements 510 is either welded to or cast with end piece 200. Parallel rigid elements 510 are each provided with a hole 511 which is used to pass a locking device such as a padlock through, and hole 511 for each of the pair of parallel rigid elements 510 are aligned with each other such that a locking device can be passed through the two holes 511 perpendicular to the planes of rigid elements 510. Parallel rigid elements 510 each have a curved shape on the side proximal to the base of barrel end piece 200, which is intended to allow easy locking as described below. The opposite end of cable 201 from cable end plug 202 terminates in a rigid cable end device 500, with a cable end plug (not shown) embedded within cable end device 500 (or alternative means of affixing cable 201 to cable end device 500). Cable end device 500 has a flat midsection of a thickness that matches the distance between rigid elements 510, and in the midsection is a hole 501 of a similar diameter to holes 511, and positioned such that, when flat midsection of cable end piece 500 is inserted between parallel rigid elements 510, all three holes (two holes 511 and hole 501) are aligned with each other in order to allow a locking device such as a padlock or a rigid element of some sort to be passed through the three holes to lock cable end piece 500 in place. Cable end piece 500 has raised sections on either side of the flat midsection with hole 501, and the proximal (relative to cable 201) raised section has a curved boundary to allow easy insertion of cable end piece 500 into the space between parallel rigid members 510 while under tension (recalling the cable 201 must be under tension to cause slide 102 to retract and thereby to place handgun 100 in a safe position). The distal (relative to cable 201) end section of cable end piece 500 also has a curved boundary, shaped to provide leverage for creating tension on cable 201 as cable end piece 500 swings into place (that is, as end piece 500 swings from a position roughly as shown to a position parallel with the side wall of barrel end piece 200 and with holes 500, 501 all properly aligned, tension on cable 201 will naturally increase due to the curvature of rigid elements 500 and the matching curvature of the distal boundary of the flat (insertable) region of cable end piece 500). Furthermore, in some embodiments finger group 502 is provided at the distal end of cable end piece 500 to allow a user to urge cable end piece 500 into position between rigid elements 510 against increasing cable 201 tension.

Figure 6:
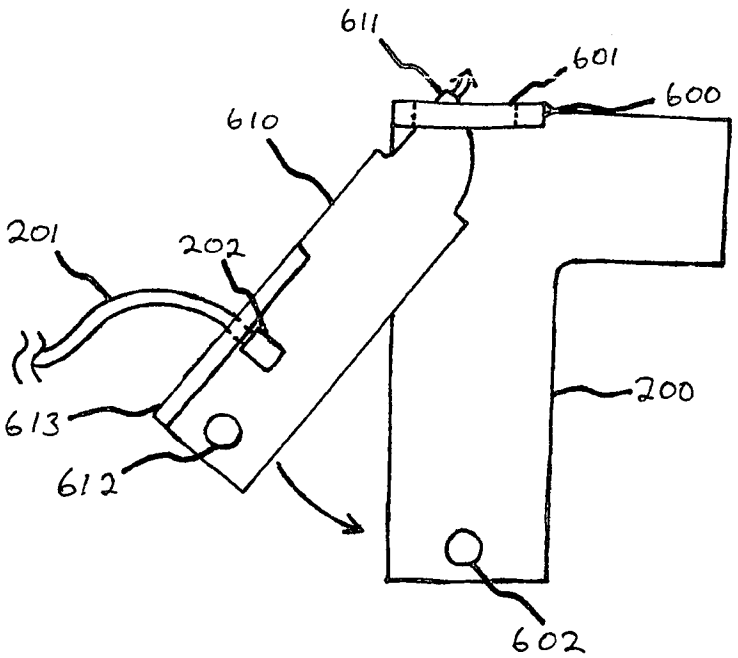
FIG. 6 is an illustration of another embodiment of the invention with another alternative locking mechanism.
Figure 6:
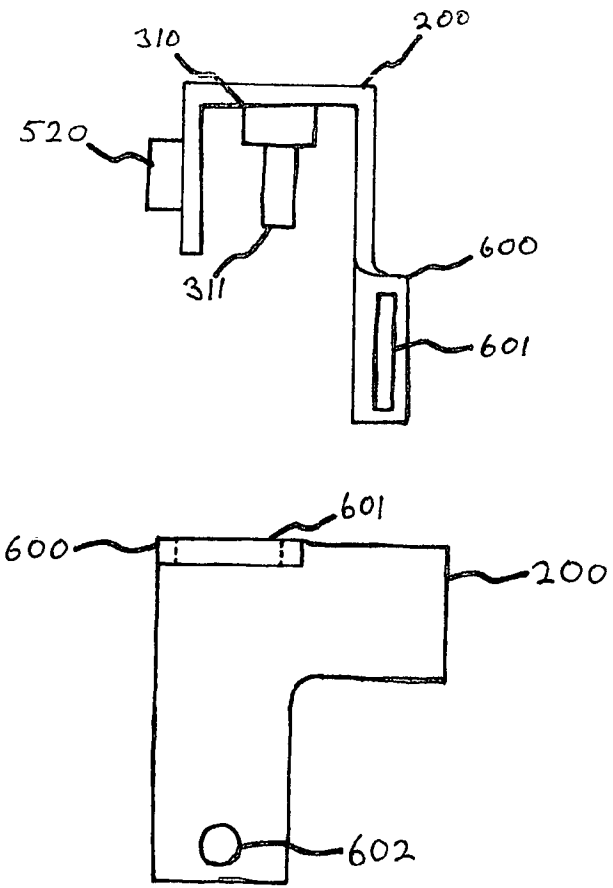

FIG. 6 shows yet another embodiment of the invention in which an alternative barrel end piece 200 design is illustrated. According to the embodiment, one of two parallel sides aligned perpendicularly to a flat midsection of barrel end piece 200 is elongated relative the other, and at its distal end (relative to the flat midsection) has a flange 600 bent outward to be approximately perpendicular to the elongated side (and approximately parallel to the flat midsection). The elongated portion of barrel end piece 200 that is terminated in flange 600 is also equipped with a flat extension that extends in a direction perpendicular to the initial direction of elongation (which was away from the flat midsection of cable end piece 200); the second elongated section is oriented in a direction that is perpendicular to both the flat midsection of barrel end piece 200 and the first elongated portion of barrel end piece 200 that extends beyond the height of the other side (where cable cover 520 is located). At the distal end of this second elongated portion of barrel end piece 200, relative to flange 600, a hole is drilled approximately in the center of the elongated portion's width dimension. Flange 600 comprises a rectangular slot 601 aligned along its longer axis. Slot 601 is used as an insertion point for modified cable end piece 610, which is a roughly rectangular plate with an end portion 611 of slightly less width. End piece 611 has one curved side, which is oriented away from a direction of approach of cable 201 (which is fitted by cable end plug 202 through a hole roughly at the opposite end of cable end piece 610). The curvature of the curved side of end piece 611 forms roughly a quarter-circle, and is adapted to allow easy rotary insertion of cable end piece 610 into slot 601, with the flat side of end piece 611 providing a leverage point to allow a user to apply tension to cable 201 by swinging the distal end (opposite from end piece 611 toward barrel end piece as shown in the right hand portion of FIG. 6. The hole through which cable 201 passes and is secured by cable end plug 202 is provided in a flanged portion of cable end piece 610 that is bent outward roughly perpendicularly from the plane of cable end piece 610, such that when cable end piece 610 is fully inserted into slot 611 the flange of cable end piece 610 is roughly perpendicular to flange 600 at the end of the elongated portion of barrel end piece 200. A hole 612 in the distal end of cable end piece 610, relative to the end with the curved portion 611, is made approximately in the center of the width dimension of cable end piece 610, and holes 602, 612 are aligned such that, when cable end piece 610 is fully inserted into slot 601, the two holes are aligned and can pass a locking device such as a padlock or other equivalent locking tool, thus fixing cable end piece 610 into position and also fixing cable 201's tension, which tension acts (as before) to pull backward on barrel 110 to pull slide 102 out of battery and thus to render handgun 100 safe. As in previous embodiments, cable 201 passes around the rear of the handgrip of frame 101 and thus allows cable 201, when placed under tension by the rotary motion of cable end piece 610 around a lever point where the flat side of end portion 611 impinges on the rearward (of gun) facing end of slot 601, causes barrel 110 to move rearward (relative to handgun 100) and thus to pull slide 102 out of battery. It will be seen by one having ordinary skill in the art that the lever arm provided by the length of cable end piece 610 serves to make application of tension to cable 201 relatively simple for any user, and is thus advantageous for providing a means of safely locking a loaded handgun 100 that does not require excessive force and yet does provide excellent security.

Figure 7:
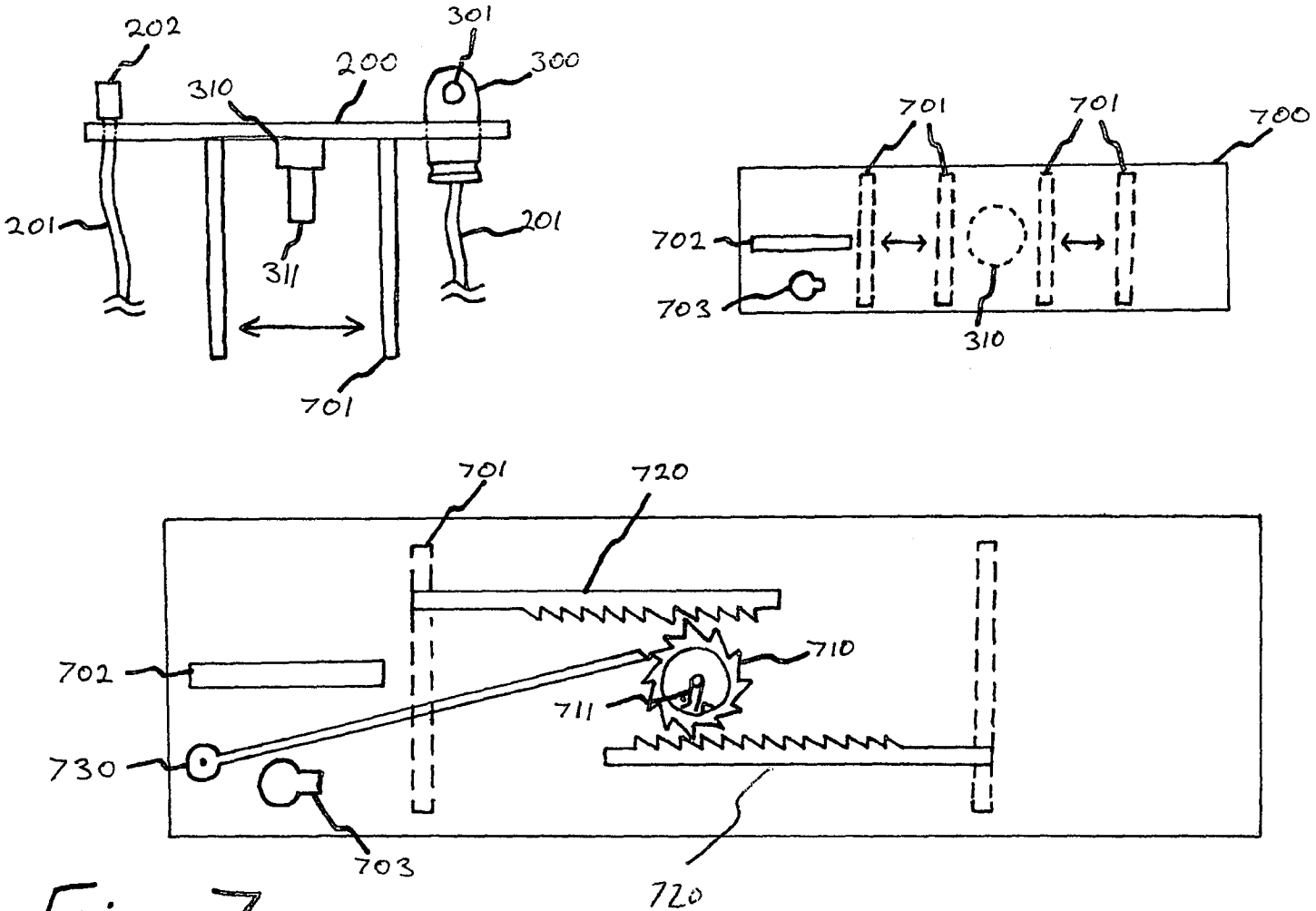
FIG. 7 is an illustration of an embodiment of the invention further comprising a ratchet and pawl mechanism to provide for use of the invention with firearms of varying sizes.

FIG. 7 illustrates an alternative embodiment of the invention in which side portions 701 of barrel end piece 200 are moveable to vary the width dimension of the gap formed between the two side portions 711. Barrel end piece 200, according to the embodiment, comprises a flat bar section 700 that is equipped with slot 702 to allow insertion of cable end piece 300 (although any cable end piece variations such as those illustrated with reference to embodiments illustrated in FIGS. 4-6 can be used with flat end piece 700). Flat barrel end piece 700 is also provided with an internal ratchet and pawl mechanism that allows side portions 701 to be moved in tandem in an outward direction (toward the ends of flat barrel end piece 700). Internal serrated bars 720 are fixed to each of side portions 710, and are aligned so that, when end pieces 710 are pulled (by hand) toward the ends of flat barrel end piece 700 they tend to wind ratchet 710 in a counterclockwise direction against spring tension provided by spring 711 mounted internal to ratchet 710. Pawl 730 acts to keep ratchet 710 from unwinding, thus allowing side portions 710 to be moved by hand to any desired separation, thus accommodating slides 102 of different sizes. One having ordinary skill in the art of mechanical design that different specific ratchet will appreciate that pawl mechanisms could be used to accomplish the same purpose. Further, such a person will also appreciate that engagement of ratchet 710 and internal serrated bars 720 acts to ensure that side portions 701 move in tandem; if a user pulls one side portion outward, the other is urged outward to the same degree by the action of ratchet 710 acting on the opposite internal serrated bar 720. Finally, a keyhole 703 or equivalent is provided so that a user may insert a key or other similar object via keyhole 703 and turn it counterclockwise to rotate pawl 730 in a counterclockwise direction about a pivot point at its distal end (relative to its engagement with ratchet 710), thus allowing spring 711 to force ratchet 710 to unwind and forcing internal serrated bars 720 inward and returning side portions 701 to their innermost positions (this occurs when rotation of pawl 730 causes it to become disengaged from ratchet 710, thus allowing spring 711 to unwind ratchet 710). The mechanism of the embodiment illustrated in FIG. 7 thus allows for a barrel end piece with sides separated by a variable width dimension, making barrel end piece suitable for use with a variety of handguns 100 with varying side 102 widths. Since handguns 100 with variable slide 102 widths may also have varying lengths and thus require different cable 201 lengths to sufficient tension to pull barrel 110 and slide 102 backward sufficiently to place them out of battery and render handgun 100 safe, such a variable-width mechanism is profitably paired with a cable tension variation mechanism such as the use of variously sized barrel insertion devices 311 as described with reference to FIG. 4. Other means, such as a cable end plug 202 that can be adjusted along cable 201's length to provide a variable cable 201 length, can also be used in conjunction with the embodiment described with reference to FIG. 7 to ensure that cable 201 tension is adequate to safe handgun 100.

All of the embodiments outlined in this disclosure are exemplary in nature and should not be construed as limitations of the invention except as claimed below. A person having ordinary skill in the design and use of handguns will appreciate that there are many variations of cable end piece 200, cable sizing arrangements, barrel insertion devices 311, barrel end pieces 200, and the like that could be use to accomplish the objectives of the invention without departing from its scope. As but one example, which would involve rendering a handgun safe according to the invention, but not lockably so, a cable end piece 300 could be pulled forward beyond a slot in the forward side of barrel end piece 200, thus placing cable 202 under tension, and then cable end piece 300 could be allowed to slide backward into the slot in barrel end piece 200, thus maintaining sufficient tension in cable 202 to pull and maintain slide 102 in an out of battery position (to render the handgun ready to fire in this case, one would need merely to pull cable end piece 300 out of the slot in barrel end piece 200 and release it).

What is claimed is:

1. A firearm safety device for use with a handgun equipped with a blowback mechanism for automatic operation, comprising:

a semiautomatic handgun having a slide and moveable barrel that is safe when the moveable barrel is not aligned parallel to the slide of the semiautomatic handgun;

a barrel end piece having a length substantially less than the length of the moveable barrel of the handgun and adapted for insertion into or around the firing end of a moveable barrel of the handgun; and a substantially non-stretchable cable attached at a first cable end to a first side of the barrel end piece;

wherein, when the cable is wrapped around a rearward portion of the semiautomatic handgun and a second cable end is secured to a second side of the barrel end piece, the cable is placed under tension; and wherein the tension on the cable pulls the semiautomatic handgun's moveable barrel into a safe position.

2. The device of claim 1, wherein the second cable end is fitted with a cable end piece adapted to allow use of a locking device to lock the second cable end to the second side of the barrel end piece, thus lockably placing the cable under tension.

3. The device of claim 2, wherein the locking device is a padlock.

4. The device of claim 1, wherein the barrel end piece further comprises a barrel insertion device having a length substantially less than the length of the moveable barrel of the semiautomatic handgun adapted to allow close fit between the barrel insertion device and the moveable barrel of the semiautomatic handgun.

5. The device of claim 4, wherein the barrel insertion device is made of a rigid material softer than the lining of the moveable barrel of the semiautomatic handgun.

6. The device of claim 4, wherein the barrel insertion device is removable.

7. The device of claim 1, wherein two parallel sides of the barrel end piece are adapted to allow them to move in tandem in order to vary an internal distance between the two sides, and further adapted to allow the two parallel sides to be locked in a desired pair of positions corresponding to a desired internal distance between the two sides.

* * * * *